US006617298B1

(12) United States Patent
Morrow et al.

(10) Patent No.: US 6,617,298 B1
(45) Date of Patent: Sep. 9, 2003

(54) DEGREASING COMPOSITIONS

(75) Inventors: Dennis S. Morrow, 1064 Calle Negocio, #B, San Clemente, CA (US) 92673; William T. Morrow, 1064 Calle Negocio, #B, San Clemente, CA (US) 92673; Kishor Pathak, Rancho Dominguez, CA (US)

(73) Assignees: Dennis S. Morrow, San Clemente, CA (US); William T. Morrow, San Clemente, CA (US)

( * ) Notice: Subject to any disclaimer, the term of this patent is extended or adjusted under 35 U.S.C. 154(b) by 0 days.

(21) Appl. No.: 10/331,307

(22) Filed: Dec. 31, 2002

(51) Int. Cl.[7] ..... C11D 3/22; C11D 14/62; C11D 17/00

(52) U.S. Cl. ..... 510/240; 510/245; 510/269; 510/271; 510/365

(58) Field of Search ..... 510/240, 245, 510/269, 271, 365

(56) References Cited

U.S. PATENT DOCUMENTS

| | | | | |
|---|---|---|---|---|
| 3,123,566 A | | 3/1964 | Kramer | |
| 3,879,216 A | * | 4/1975 | Austin | 134/4 |
| 4,767,563 A | | 8/1988 | de Buzzaccarini | |

* cited by examiner

*Primary Examiner*—Yogendra N. GuptaJohn
*Assistant Examiner*—John M. Petruncio
(74) *Attorney, Agent, or Firm*—Boniard I. Brown

(57) ABSTRACT

A composition for the removal of grease and oil spots from concrete, asphalt surfaces, etc., comprises a degreaser and a diatomaceous earth. The degreaser comprises a number of ingredients of respective percentage ranges to emulsify the grease or oil which is then absorbed by the diatomaceous earth.

5 Claims, No Drawings

DEGREASING COMPOSITIONS

BACKGROUND AND SUMMARY

The present invention relates to compositions for the removal of grease and oil spots from concrete, asphalt, and certain other surfaces.

The composition of each comprises two components. One is a specialty degreaser to emulsify the oil and grease or stains, and which is then absorbed by the diatomaceous earth.

Before applying the composition according to the invention, the ingredients are mixed into a paste or thick fluid.

The compositions according to the invention are preferably utilized by first spraying a pre-treat material over a spot to be cleaned, scrubbing the spot area, applying a composition of the invention and allowing it to dry.

Example detailing the respective ingredients and their respective percentages in the compositions of the invention are set forth in the specifications as Examples I and II, and are defined in the claims.

DESCRIPTION OF THE PREFERRED EMBODIMENTS

The present invention relates to compositions for the removal of grease and oil spots from concrete, asphalt and the like.

The product or compositions comprise two components, one a specialty degreaser and the other an amorphous diatomaceous earth. The diatomaceous earth utilized may preferably be such as that known by the trade name Diafil 570 CAS #61790-53-2, of CR Minerals, Golden Colo. The degreaser comprises a non-ionic surfactant CAS #12787-87-0, and 1-butoxy 2-propanol CAS #513131-66-8.

The ingredients are mixed into a paste of a thick fluid consistency somewhat similar to that of a pancake batter.

Compositions according to the invention are useful for driveways, sidewalks, basement concrete, garage floors, patios, pool areas, etc. The compositions are safe, effective and biodegradable.

Utilization of compositions according to the invention preferrably comprises the steps of: (1) spraying a pre-treat material over the spot to be cleaned, (2) scrubbing the area about the spot, as with a brush, (3) wiping away any excess pre-treat material or product, (4) applying a composition according to the invention, as with a spatula or the like, (5) allowing the composition to dry for twelve to twenty-four hours, (6) sweeping away dried product, and (7) sweeping up excess product, as by means of a wet sponge.

The degreaser emulsifies oil and grease, and is absorbed into the diatomaceous earth as the mixture dries out.

Set forth below are preferred compositions proved effective in the course of development and research in successfully removing grease and oil spots from concrete, asphalt and the like.

EXAMPLE I

| Ingredient | Weight Percent |
|---|---|
| sodium tripolyphosphate | 1.34 |
| sodium meta silicate, anhydrous | .63 |
| ethoxylated nonylphenol | 1.58 |
| propylene glycol n-propyl ether | 1.20 |
| dipropylene glycol methyl ether | 0.13 |
| 4-isopenyl-1methylcyclohexane | 0.16 |
| ethoxylated phosphate ester | 0.95 |
| phosphoric acid | 0.09 |
| amorphous diatomaceous earth | 37.00 |
| water | 56.93 |

EXAMPLE II

| Ingredient | Weight Percent | | |
|---|---|---|---|
| sodium tripolyphosphate | 1.00 | to | 3.00 |
| sodium meta silicate, anhydrous | 0.50 | to | 3.00 |
| ethoxylated nonylphenol | 0.50 | to | 3.00 |
| propylene glycol n-propyl ether | 1.00 | to | 5.00 |
| dipropylene glycol methyl ether | 0.50 | to | 3.00 |
| 4-isopenyl-1methylcyclohexane | 0.05 | to | 2.00 |
| ethoxylated phosphate ester | 1.00 | to | 3.00 |
| phosphoric acid | 0.00 | to | 0.50 |
| amorphous diatomaceous earth | 30.00 | to | 45.00 |
| water | | to | 100.00% |

It has been found in the course of development and research that either or both of sodium tripolyphosphate and phosphoric acid may be eliminated from the composition while still providing an effective composition according to the invention.

It will be understood that various changes and modifications may be made from the preferred embodiments discussed above without departing from the scope of the present invention, which is established by the following claims and equivalents thereof.

We claim:

1. A composition for removing grease and oil spots from concrete and asphalt, comprising:

sodium meta silicate, anhydrous in an amount of about 0.63 weight percent, ethoxylated nonylphenol in an amount of about 1.58 weight percent, propylene glycol n-propyl ether in an amount of about 1.20 weight percent, dipropylene glycol methyl ether in an amount of about 0.13 weight percent, 4-isopenyl-1methylcyclohexane in an amount of about 0.16 weight percent, ethoxylated phosphate ester in an amount of about 0.95 weight percent, amorphous diatomaceous earth in an amount of about 37.00 weight percent, and water in an amount of about 58.36 weight percent.

2. A composition for removing grease and oil spots from concrete and asphalt, comprising:

sodium tripolyphosphate in an amount of about 1.34 weight percent, sodium meta silicate, anhydrous in an amount of about 0.63 weight percent, ethoxylated nonylphenol in an amount of about 1.58 weight percent, propylene glycol n-propyl ether in an amount of about 1.20 weight percent, dipropylene glycol methyl ether in an amount of about 0.13 weight percent, 4-isopenyl-1methylcyclohexane in an amount of about 0.16 weight percent, ethoxylated phosphate ester in an amount of about 0.95 weight percent, phosphoric acid in an amount of about 0.09 weight percent, amorphous diatomaceous earth in an amount of about 37.00 weight percent, and water in an amount of about 56.93 weight percent.

3. A composition for removing grease and oil spots from concrete and asphalt, comprising:

sodium meta silicate, anhydrous in an amount ranging from about 0.50 to 3.00 weight percent, ethoxylated nonylphenol in an amount ranging from 0.50 to 3.00 weight percent, propylene glycol n-propyl ether in an amount ranging from 1.00 to 5.00 weight percent, dipropylene glycol methyl ether in an amount ranging from 0.50 to 3.00 weight percent, 4-isopenyl-1methylcyclohexane in an amount ranging from 0.05 to 2.00 weight percent, ethoxylated phosphate ester in an amount ranging from 1.00 to 3.00 weight percent, amorphous diatomaceous earth in an amount ranging from 30.00 to 45.00 weight percent, and the balance of the composition comprises water.

4. A composition for removing grease and oil spots from concrete and asphalt, comprising:

sodium tripolyphosphate in an amount ranging from about 1.00 to about 3.00 weight percent, sodium meta silicate, anhydrous in an amount ranging from about 0.50 to 3.00 weight percent, ethoxylated nonylphenol in an amount ranging from 0.50 to 3.00 weight percent, propylene glycol n-propyl ether in an amount ranging from 1.00 to 5.00 weight percent, dipropylene glycol methyl ether in an amount ranging from 0.50 to 3.00 weight percent, 4-isopenyl-1methylcyclohexane in an amount ranging from 0.05 to 2.00 weight percent, ethoxylated phosphate ester in an amount ranging from 1.00 to 3.00 weight percent, amorphous diatomaceous earth in an amount ranging from 30.00 to 45.00 weight percent, and the balance of the composition comprises water.

5. A composition for removing grease and oil spots from concrete and asphalt, comprising:

sodium tripolyphosphate in an amount ranging from about 1.00 to about 3.00 weight percent, sodium meta silicate, anhydrous in an amount ranging from about 0.50 to 3.00 weight percent, ethoxylated nonylphenol in an amount ranging from 0.50 to 3.00 weight percent, propylene glycol n-propyl ether in an amount ranging from 1.00 to 5.00 weight percent, dipropylene glycol methyl ether in an amount ranging from 0.50 to 3.00 weight percent, 4-isopenyl-1methylcyclohexane in an amount ranging from 0.05 to 2.00 weight percent, ethoxylated phosphate ester in an amount ranging from 1.00 to 3.00 weight percent, phosphoric acid in an amount ranging from 0.00 to 0.50 weight percent, amorphous diatomaceous earth in an amount ranging from 30.00 to 45.00 weight percent, and the balance of the composition comprises water.

* * * * *